US007011366B1

(12) United States Patent
Cornella

(10) Patent No.: US 7,011,366 B1
(45) Date of Patent: Mar. 14, 2006

(54) FOOT AND LEG PROTECTOR FOR INFANT SEAT BOUNCER

(76) Inventor: Marc A. Cornella, 9 Benham Way, Sparta, NJ (US) 07871

( * ) Notice: Subject to any disclaimer, the term of this patent is extended or adjusted under 35 U.S.C. 154(b) by 0 days.

(21) Appl. No.: 11/080,594

(22) Filed: Mar. 15, 2005

(51) Int. Cl.
*A47C 31/00* (2006.01)

(52) U.S. Cl. ..... 297/219.12; 297/219.1; 297/228.13; 297/452.13; 297/DIG. 11

(58) Field of Classification Search ..... 297/219.12, 297/219.1, 228.13, 452.13, DIG. 11, 463.1, 297/463.2
See application file for complete search history.

(56) References Cited

U.S. PATENT DOCUMENTS

| | | | | |
|---|---|---|---|---|
| 3,603,639 | A * | 9/1971 | Wilson | 297/219.1 |
| 4,188,678 | A * | 2/1980 | Rawolle | 5/105 |
| 5,048,892 | A * | 9/1991 | Ledbetter | 297/219.1 |
| 5,383,711 | A | 1/1995 | Houghteling | 297/397 |
| 5,700,053 | A * | 12/1997 | Downing | 297/227 |
| 5,904,406 | A * | 5/1999 | Stewart | 297/397 |
| 5,906,413 | A * | 5/1999 | Yang | 297/284.5 |
| 6,036,263 | A | 3/2000 | Gold | 297/219.12 |
| 6,266,832 | B1 * | 7/2001 | Ezell | 5/640 |
| 6,343,944 | B1 | 2/2002 | Okabe | 439/157 |
| 6,390,555 | B1 | 5/2002 | Wilkins et al. | 297/354.13 |
| 6,511,126 | B1 * | 1/2003 | McAdams | 297/217.1 |
| 2003/0020317 | A1 | 1/2003 | Keegan et al. | 297/446.2 |
| 2003/0057744 | A1 | 3/2003 | Wilkins et al. | 297/126 |
| 2004/0094923 | A1 | 5/2004 | Eros et al. | 280/47.38 |

* cited by examiner

*Primary Examiner*—Laurie K. Cranmer
(74) *Attorney, Agent, or Firm*—Ernest D. Buff & Associates, LLC; Ernest D. Buff; Theodore J. Pierson

(57) ABSTRACT

An apparatus protects the feet and legs of an infant from certain rigid parts of an infant bouncer seat while the infant is sitting and playing in the bouncer seat. A foot and leg protector includes a unitary and elongated, shell, wherein the shell is u-shaped when viewed from its top surface. Padded material having a thickness of at least about one half inch is disposed within the shell. The foot and leg protector further includes a removable attachment means including a male part and a female part. The male part is located on the bottom surface of the foot and leg protector and the female part is located substantially near the front lip of the bouncer seat. The removable attachment means is operable to removably attach the foot and leg protector to the bouncer seat such that the foot and leg protector covers substantially the entire portion of the front lip of the bouncer seat, and front portions of left and right side lips. The removable attachment means may include buttons, zippers, hook and loop type fasteners, snaps, magnets, or the like. The foot and leg protector operates to protect a child's feet and legs from pain and discomfort that otherwise would be experienced from physical contact with certain rigid parts located near the front, left and right lips of the bouncer seat while the child is sitting and playing in the bouncer seat.

18 Claims, 2 Drawing Sheets

FOOT AND LEG PROTECTOR FOR INFANT SEAT BOUNCER

BACKGROUND OF THE INVENTION

1. Field of the Invention

The present invention relates to the field of infant bouncer seats; and more particularly, to a foot and leg protector for an infant seat bouncer.

2. Description of the Prior Art

Bouncer seats have become very popular. They keep a child safely entertained while at the same time helping to develop his motor skills. A parent can place her child in a bouncer seat and carry on with household chores and the like without worrying about whether her child is safe. A bouncer seat has certain rigid parts, typically located near its front lip, which pose a threat to the child; this risk includes significant pain and discomfort to a child's legs and feet while sitting and playing in the bouncer seat. These rigid parts are especially problematic when a child kicks his legs, an activity frequently carried out by babies while playing in a bouncer seat.

One troublesome problem with bouncer seats is the tendency of certain rigid parts near the front lip of the seat to cause pain and discomfort to the feet and legs of a child sitting therein. Information relevant to attempts to address this problem can be found in U.S. Pat. Nos. 5,383,711; 6,036,263; 6,343,994; and 6,390,555; as well as U.S. Patent Application Nos. 2003/0020317; 2003/0057744; and 2004/0094923. However, each one of these references suffers from one or more of the following disadvantages: (i) the device is not removable, via removable attachment means; (ii) the device is not unitary, that is to say, it does not cover substantially the entire portion of the front lip of a bouncer seat; (iii) the device does not have padding material of a sufficient thickness, i.e. at least one half inch, to protect the child's feet and legs from the rigid parts near the front lip of a bouncer seat; and (iv) the padded material does not have a suitable length and width to be properly installed on a bouncer seat such that it covers substantially the entire portion of the front lip.

For example U.S. Pat. No. 5,383,711 to Houghteling discloses a head support for use with infant retaining devices adapted to retain a user's head in an upright orientation while sleeping. Houghteling teaches a head support with a liner sheet connected to it. The liner sheet is preferably formed from either two fabric sheets that are lightly padded or a quilted fabric material and is dimensioned to at least partially underlie the torso of an infant or small child. The liner sheet includes a bifurcated bottom end portion forming legs connected by a substantially transverse edge of a central recess or notch. The notch accommodates the conventional buckle of a retaining strap or harness in the region of releasable attachment to the seat bottom portion to retain an infant. Because Houghteling requires a central recess or notch, it does not teach a device having a unitary construction that covers substantially the entire front lip of a bouncer seat. The Houghteling device further does not comprise removable attachment means for removably attaching a padded unit to a bouncer seat.

As another example, U.S. Pat. No. 6,036,263 to Gold discloses an infant rest, adapted for use with infant support devices. The infant rest taught by Gold supports the infant's head against sudden movements and impacts resulting therefrom. It also protects the infant from the effects of the environment, such as excessive sun, wind, cold or other environmental causes. A double padded layer extends upward into a single layer to form a bonnet around the head of the infant. The infant protective device includes a base panel having a lower notch that forms two leg portions. Because of this, the Gold reference does not teach a device having a unitary construction that covers substantially the entire front lip of a bouncer seat. The Gold device does not comprise removable attachment means for removably attaching a padded unit to a bouncer seat.

As another example, U.S. Patent Application 2003/0020317 to Keegan et al. discloses a baby bouncer having a frame with a base. A pair of upwardly and forwardly extending legs, connected to the base, carry a baby support so that a baby placed in the support faces in a forwardly direction. The Keegan et al. device comprise a wire frame and fabric that form a cradle for supporting the baby in the bouncer. The fabric cradle may typically be made of a quilted fabric provided with pockets on the back thereof that slip over the U-shaped wires of the frame so that the wires support the fabric. The edges of the fabric are preferably padded so as to form a bumper around the periphery of the cradle and prevent the baby in the cradle from bumping its head or any other part of the body against the U-shaped wires. The Keegan et al. device does not teach padding material having a sufficient thickness, i.e. at least one half inch, to protect a child's feet and legs from the rigid parts near the front lip of a bouncer seat. The Keegan et al. reference further does not teach a separate protective device of appropriate dimensions which is removably attached near the front lip of a bouncer seat via removable attachment means. Instead, the Keegan et al. reference teaches that the entire fabric sheet should be allowed to be detached from the frame, in which case the bouncer seat would be useless during the time that the sheet is removed, since the sheet forms the cradle that supports the infant.

There remains a need in the art for an inexpensive, reliable apparatus that is readily installed for use with existing bouncer seats, and provides a padding that protects the feet and legs of a child from certain rigid parts near the front lip of a bouncer seat when the child is sitting and playing therewithin.

SUMMARY OF THE INVENTION

The present invention provides a foot and leg protector especially suited for use with an infant bouncer seat having a front lip portion. The foot and leg protector has a bottom surface and a top surface, and includes a unitary, elongated, and unshaped shell. Disposed within the shell is padded material having a thickness of at least one half inch. The foot and leg protector further includes removable attachment means comprising a male part and a female part. The male part is located on the bottom surface of the foot and leg protector and the female part is located substantially near the front lip of the bouncer seat. The removable attachment means is operable to removably attach the foot and leg protector to the bouncer seat such that the foot and leg protector covers substantially the entire portion of the front lip of the bouncer seat.

The foot and leg protector operates to protect a child's feet and legs from pain and discomfort that otherwise would be experienced from physical contact with certain rigid parts located near the front lip of the bouncer seat while the child is sitting and playing in the bouncer seat.

The present invention includes one or more rows of removable attachment means. The removable attachment means may include buttons, zippers, hook and loop type fasteners, snaps, magnets, or the like. The removable attachment means include a male part and a female part. The male part is located on the bottom surface of the foot and leg protector. The female part is located on the bouncer seat. Alternatively, only the male part, such as the hook portion of a hook and loop type fastener, is installed such that there is no female part required. In another embodiment, the padded material is not disposed within a shell, but rather is capable of retaining its shape by itself, without such a shell.

The present invention solves the problems associated with certain rigid parts located near the front lip of a typical bouncer seat. Infants sitting in a bouncer seat equipped with the padded material are afforded protection against injuries otherwise caused when their legs repeatedly contact seat's front lip. The padded material is preferably disposed within a shell. Removable attachment means are operable to secure the foot and leg protector to the bouncer seat so that the protector covers substantially the entire front lip thereof.

BRIEF DESCRIPTION OF DRAWINGS

The invention will be more fully understood and further advantages will become apparent when reference is had to the following detailed description of the preferred embodiments and the accompanying drawings, in which.

DESCRIPTION OF THE PREFERRED EMBODIMENTS

Figure 1:
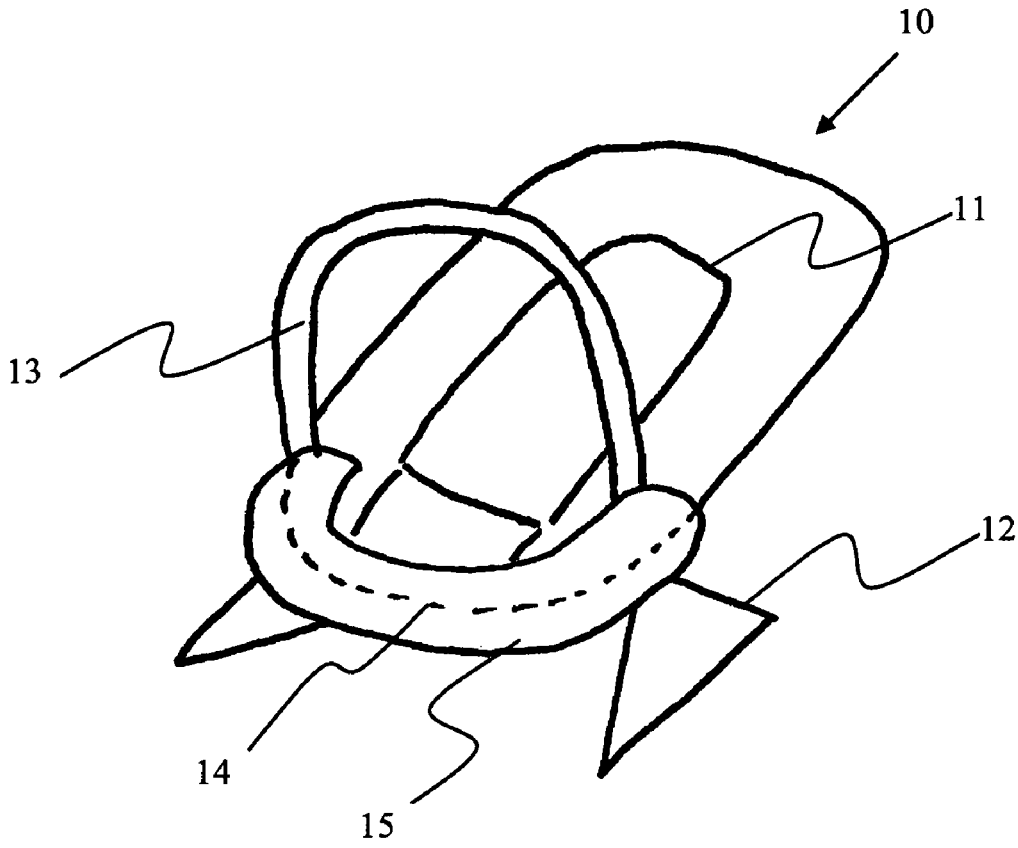
FIG. 1 is a perspective view depicting an infant bouncer seat equipped with a foot and leg protector in accordance with the invention.
Figure 2:
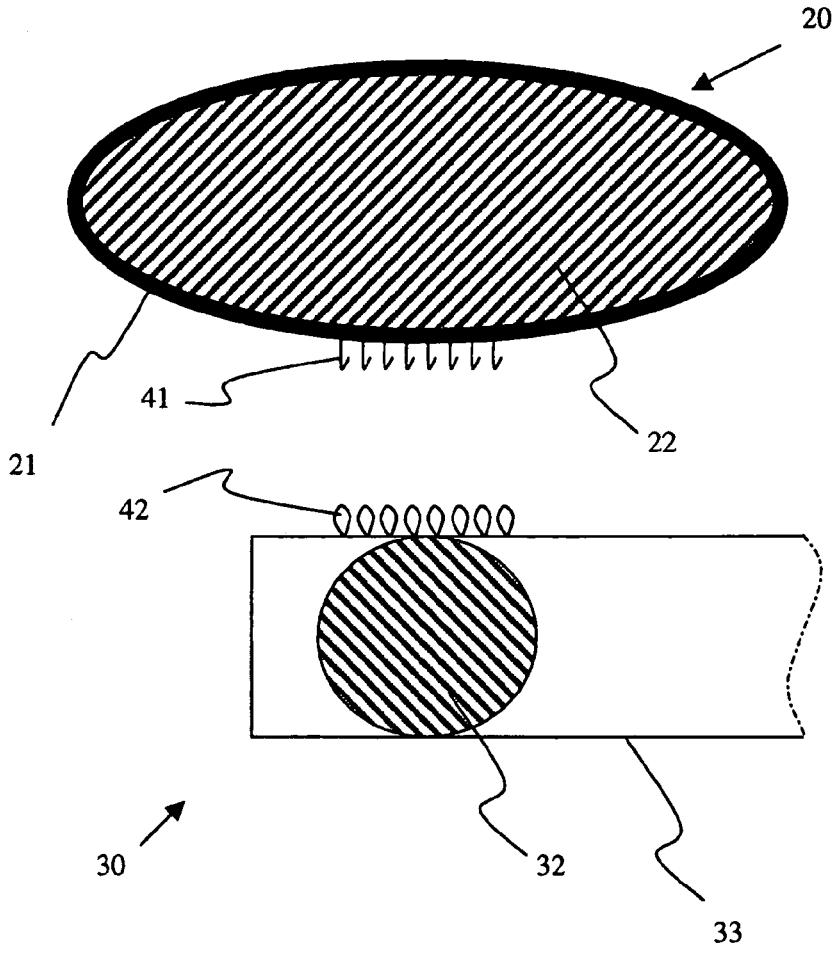
FIG. 2 depicts a cross sectional view of the foot and leg protector, a cross sectional view of the front lip portion of the bouncer seat, and a side view of one embodiment of a removable attachment means of the infant seat bouncer protector in accordance with the invention.

The apparatus of the present invention comprises a foot and leg protector for an infant bouncer seat, the foot and leg protector having padded material disposed within a shell. The padded material comprises one or more of the following: an air cushion, a plurality of feathers, a plurality of cotton balls, viscoelastic gel, and foam rubber. The shell is preferably constructed from upholstery. Preferably, the color of the upholstery is selected so that it blends with or otherwise matches the color scheme of the bouncer seat. Alternatively, the shell is constructed from a polymeric material, especially when an air cushion is selected as the padded material, such as to create an airtight shell. The bouncer seat protector includes removable attachment means for removably attaching the bouncer seat protector to the bouncer seat. The bouncer seat protector of the present invention is depicted by FIGS. 1–2.

The present invention comprises a foot and leg protector for an infant seat bouncer comprising a protective, padded component. Advantageously, the protective, padded component prevents the feet and legs of a child from striking against certain rigid parts that are exposed near the front lip of a typical bouncer seat. These exposed parts may include a rigid wire frame located towards the front of a bouncer seat. They present a danger to an infant that is sitting in the bouncer seat and kicking his feet in a natural manner. Even when an infant is merely sitting and resting in the bouncer seat, his feet and legs are still adversely affected by the edge of the rigid wire frame.

When used in connection with a child bouncer seat, the present invention creates a protective, padded barrier that separates the child's feet and legs from the rigid exposed parts residing near the front lip of the bouncer seat. When both resting and kicking his feet, a child is protected from these rigid parts. The child remains comfortable and fully protected from the dangers associated with these rigid parts. The unit is very easy to install. It is extremely reliable, and is virtually maintenance free. Protective padded components constructed in accordance with the invention have long service lives.

Once installed, the bouncer seat protector overlaps substantially the entire front lip of the bouncer seat. The unit has an appropriate thickness, typically at least one half inch and preferably more than one inch, so that it will sufficiently absorb the impact from the child's feet and legs while kicking. The bouncer seat thickness is preferably in the range of one to six inches. More preferably the bouncer seat thickness is in the range of two to four inches.

The unit is a removable addition to an infant bouncer seat. It is removably attached to the bouncer seat through one or more of the following: buttons, zippers, hook and loop type fasteners, such as VELCRO®, snaps, magnets, or the like. Alternatively, the bouncer seat protector is permanently attached to the bouncer seat during the manufacturing process, such as by stitching.

FIG. 1 depicts an infant bouncer seat 10 modified by the unit of the present invention. The bouncer seat includes a recess 11 for securely holding the child when sitting. The seat further includes a set of bouncer feet 12, as well as an optional handle 13, operable for use with dangling toys and other parts for the child's entertainment. The padded material 15 of the present invention is shown being located along the front edge 14 of the bouncer seat.

FIG. 2 depicts a cross section view of the foot and leg protector, a cross section view of the front lip portion of the bouncer seat, and a side view of one embodiment of removable attachment means of the infant seat bouncer protector in accordance with the invention. A cross sectional view of the foot and leg protector is shown generally at 20. Padded material 22 is disposed within a shell 21. A cross sectional view of the front lip portion of the bouncer seat is shown generally at 30. A rigid part 32 comprises the structural support for the front lip portion of the bouncer seat. A layer of material 33 surrounds the rigid part 32 and provides a surface for the infant to sit. Removable attachment means 41, 42 are depicted as hook and loop type for purposes of illustration, wherein the hook portion 41 of the attachment means is located on the bottom surface of the foot and leg protector and the loop portion 42 is located near the front lip of the bouncer seat. When the removable attachment means 41, 42 are engaged with one another, the padded material 22 of the foot and leg protector provides protection for the infant from contact with the rigid part 32 of the front lip portion of the bouncer seat. The padded material also protects the infant from contact with the rigid parts located near the front section of the left and right lips (not shown). The shell 21 houses the padded material 22.

The bouncer seat protector shell comprises a unitary, elongated, u-shaped unit. The term "unitary" is defined by the present application in that the shell exists along a continuous path from one end of the u-shape to the other end of the u-shape. The term "elongated" is defined by the present application in that the shell preferably has a length greater than ten inches. More preferably the shell has a length in the range of ten to fifty inches, as measured along the u-shaped path. More preferably, the length of the shell is in the range of fifteen to thirty inches. The term "u-shaped" as defined by the present application means that the shell has a shape that substantially corresponds to the curvature of the front lip of the bouncer seat, thereby facilitating the removable connection of the bouncer seat protector and the bouncer seat along their respective attachment means. The material of the shell is flexible, such that the shape can be adjusted depending on the curvature of the bouncer seat. That is to say, the shell is not rigid, but retains some flexibility and deforms under loading.

The shell has a substantially constant width along its entire length. Preferably the width is in the range of one to twelve inches, if measured when the bouncer seat protector is laid substantially flat.

One row of attachment means is used to removably attach the bouncer seat protector to the front of the bouncer seat. The attachment means comprises a pair of interlocking elements, or male and female parts. A male part is provided along the bottom surface of the bouncer seat protector and mounted on the shell. A female part is installed substantially along the front lip of the bouncer seat with glue, two-side tape, stitching, or the like. When the male and female parts are connected, the bouncer seat protector substantially covers the entire front lip portion of the bouncer seat, as depicted in FIG. 1, in order to protect the child's feet and legs from pain and discomfort that otherwise would be experienced from physical contact with certain rigid parts located near the front of said bouncer seat. The bouncer seat protector is held in position by the attachment means and is capable of staying in place while a child is sitting and playing in the bouncer seat.

Alternatively, two or more rows of attachment means are used to removably attach the bouncer seat protector to the front of the bouncer seat. In one such embodiment, a first row of attachment means is located parallel to the front lip of the bouncer seat and offset by about one to six inches towards the back of the bouncer seat. A second row of attachment means is further located parallel to the front lip of the bouncer seat and offset by about one to six inches towards the front of the bouncer seat. According to the shape of the front of the bouncer seat, the second row of attachment means may be positioned on the bottom surface of the bouncer seat, such that the bouncer seat protector wraps-around the front lip to ensure adequate protection from certain rigid parts located thereon.

Alternatively, the rows of attachment means include a male part along the bottom surface of the bouncer seat protector and mounted on the shell and do not include a female part on the bouncer seat. Preferably, the male part of the attachment means which is mounted on the bottom surface of the bouncer seat protector is the hook portion of a hook and loop type fastener. The hook portion engages with the fabric of the bouncer seat to provide for a removable attachment which keeps the bouncer seat protector in position with the assistance of the friction existing between the hook portion and the bouncer seat's fabric. With this arrangement, the bouncer seat protector is capable of being used with any type of bouncer seat without having to first alter the bouncer seat by installing attachment means on its surface.

In another embodiment the bouncer seat protector is constructed from a quilted material having a thickness greater than one inch and preferably two to four inches. In this embodiment a separate shell is not required, as the quilted material is held together on its own. Other types of padded material not requiring a separate shell can be used such as foam rubber, viscoelastic gel, and the like. Removable attachment means having a male part and female part are installed to the padded material and bouncer seat, respectively, although the male part of the attachment means is mounted directly on the bottom surface of the padded material, as a shell is not required with this embodiment.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A foot and leg protector having a bottom surface and a top surface for use with an infant bouncer seat having a front lip portion, a left lip having front and rear sections, and a right lip having front and rear sections comprising:

a. a unitary and elongated shell, said shell being u-shaped when viewed from said top surface;

b. padded material disposed within said shell, said padded material having a thickness of at least one half inch;

c. removable attachment means including a male part and a female part, said male part being located on said bottom surface of said foot and leg protector and said female part being located substantially near said front lip of said bouncer seat, and said removable attachment means being operable to removably attach said foot and leg protector to said bouncer seat such that said foot and leg protector covers substantially the entire portion of said front lip, the front section of said left lip, and the front section of said right lip of said bouncer seat;

whereby said protector operates to protect a child's feet and legs from pain and discomfort that otherwise would be experienced from physical contact with certain rigid parts located near said front, left, and right lips of said bouncer seat while said child is sitting and playing in said bouncer seat.

2. The foot and leg protector as recited by claim 1, wherein said shell is made from soft upholstery.

3. The foot and leg protector as recited by claim 1, wherein said shell is composed of a polymeric material.

4. The foot and leg protector as recited by claim 1, wherein said padded material comprises an air cushion.

5. The foot and leg protector as recited by claim 1, wherein said padded material comprises a plurality of feathers.

6. The foot and leg protector as recited by claim 1, wherein said padded material comprises a plurality of cotton balls.

7. The foot and leg protector as recited by claim 1, wherein said padded material is composed of viscoelastic gel.

8. The foot and leg protector as recited by claim 1, wherein said padded material is composed of foam rubber.

9. The foot and leg protector as recited by claim 1, wherein said padded material thickness is greater than one inch.

10. The foot and leg protector as recited by claim 1, wherein said padded material thickness ranges from about one to six inches.

11. The foot and leg protector as recited by claim 1, wherein said padded material thickness ranges from two to four inches.

12. The foot and leg protector as recited by claim 1, wherein said removable attachment means comprises a plurality of buttons.

13. The foot and leg protector as recited by claim 1, wherein said removable attachment means comprises a plurality of zippers.

14. The foot and leg protector as recited by claim 1, wherein said removable attachment means comprises a plurality of hook and loop type fasteners.

15. The foot and leg protector as recited by claim 1, wherein said removable attachment means comprises a plurality of snaps.

16. The foot and leg protector as recited by claim 1, wherein said removable attachment means comprises a plurality of magnets.

17. A foot and leg protector having a bottom surface and a top surface for use with an infant bouncer seat having a front lip portion, a left lip having front and rear sections, and a right lip having front and rear sections comprising:

a. a unitary and elongated shell, said shell being u-shaped when viewed from said top surface;

b. padded material disposed within said shell, wherein said padded material has a thickness of at least one half inch;

c. removable attachment means including a male part, said male part being located on said bottom surface of said foot and leg protector, and said removable attachment means being operable for removably attaching said foot and leg protector to said bouncer seat such that said foot and leg protector covers substantially the entire portion of said front lip, the front section of said left lip, and the front section of said right lip of said bouncer seat;

whereby said protector operates to protect a child's feet and legs from pain and discomfort that otherwise would be experienced from physical contact with certain rigid parts located near said front, left, and right lips of said bouncer seat while said child is sitting and playing in said bouncer seat.

18. A foot and leg protector having a bottom surface and a top surface for use with an infant bouncer seat having a front lip portion, a left lip having front and rear sections, and a right lip having front and rear sections comprising:

a. unitary and elongated padded material, having a thickness of at least one inch, said shell being unshaped when viewed from said top surface;

b. removable attachment means including a male part and a female part, said male part being located on said bottom surface of said foot and leg protector and said female part being located substantially near said front lip of said bouncer seat, and said removable attachment means being operable to removably attach said foot and leg protector to said bouncer seat such that said foot and leg protector covers substantially the entire portion of said front lip, the front section of said left lip, and the front section of said right lip of said bouncer seat;

whereby said protector operates to protect a child's feet and legs from pain and discomfort that otherwise would be experienced from physical contact with certain rigid parts located near said front, left, and right lips of said bouncer seat while said child is sitting and playing in said bouncer seat.

* * * * *